US006875125B1

(12) United States Patent
Federowicz

(10) Patent No.: US 6,875,125 B1
(45) Date of Patent: Apr. 5, 2005

(54) GOLF PUTTER GRIP AND METHOD OF USE

(76) Inventor: John S. Federowicz, 568 Browns Rd., Storrs, CT (US) 06268

( * ) Notice: Subject to any disclaimer, the term of this patent is extended or adjusted under 35 U.S.C. 154(b) by 0 days.

(21) Appl. No.: 10/678,320

(22) Filed: Oct. 3, 2003

Related U.S. Application Data

(60) Provisional application No. 60/420,102, filed on Oct. 22, 2002.

(51) Int. Cl.[7] ..... A63B 53/14

(52) U.S. Cl. ..... 473/303; 473/409; 473/203

(58) Field of Search ..... 473/300–303, 473/294, 201, 203, 204, 409; D21/756, 758; 74/551.9; 81/489–492; 16/430

(56) References Cited

U.S. PATENT DOCUMENTS

| | | | | |
|---|---|---|---|---|
| 4,215,860 | A * | 8/1980 | Nakamatsu | 473/201 |
| 4,746,120 | A | 5/1988 | Mockovak | |
| 4,880,240 | A | 11/1989 | Lewis | |
| D355,011 | S | 1/1995 | Subnick | |
| 5,377,984 | A | 1/1995 | Ciccia | |
| D399,901 | S | 10/1998 | Beyer | |

* cited by examiner

*Primary Examiner*—Stephen Blau
(74) *Attorney, Agent, or Firm*—John H. Crozier

(57) ABSTRACT

In a preferred embodiment, a grip for a golf putter, including: a center member; and two side members coaxially aligned side-by-side with the center member, such as to define therebetween two grooves each of the two grooves disposed between one of the side members and the center member. A method of using the golf putter grip is also provided.

9 Claims, 4 Drawing Sheets

(Priort Art)

(Priort Art)

GOLF PUTTER GRIP AND METHOD OF USE

CROSS-REFERENCE TO RELATED APPLICATION

The present application claims the benefit of the filing date of U.S. Provisional Application No. 60/420,102, filed Oct. 22, 2002, and titled BETTER PUTT—GOLF PUTTER GRIP. The subject matter of the present application was at least partially disclosed in Disclosure Document No. 514, 818, filed Jul. 8, 2002.

BACKGROUND OF THE INVENTION

1. Field of the Invention

The present invention relates to the game of golf generally and, more particularly, but not by way of limitation, to a novel golf putter grip and method of use thereof.

2. Background Art

While the game of golf as the game is known today originated in Scotland, the time and place are obscure. However, it was so popular in the 15th century that the $14^{th}$ parliament of King James II of Scotland issued a decree in 1457 that the game was not to be played because it interfered with the practice of archery, an essential element in the defense of the realm. That the game was well established is further supported by the fact that two subsequent Scottish parliaments found it necessary to issue similar decrees in 1471 and 1491 in efforts to suppress the game, and it appears that none of the three was effective. The precursors of golf may extend back to the Roman empire. The popularity of the game has not diminished over the years.

One facet of the game of golf is putting the golf ball once the golf ball has reached a green. Oftentimes, this is the hardest part of the game. A particular problem with conventional golf putters is that the elbows of the user tend to be spread apart from the body of the user. This spreading apart tends to cause instability in the stroking of the golf ball. Another problem with conventional golf putters is that one cannot be sure that the golf putter is gripped the same way each time the golf putter is used.

Some attempts to improve the conventional golf club are as follows:

U.S. Pat. No. 4,746,120, issued May 24, 1988, to Mockovak, and titled GOLF CLUB PUTTER AND HANDGRIP THEREFOR, describes a putter having an enlarged cylindrical grip. The putter may be centered in the grip or it may be somewhat offset from the center thereof.

U.S. Pat. No. 4,880,240, issued Nov. 14, 1989, to Lewis, and titled PUTTING PRACTICE DEVICE, describes a triangularly shaped putter grip that has a flat surface thereon that cooperates with and is guided by a flat surface worn on the golfer's belt.

U.S. Pat. No. 5,377,984, issued Jan. 3, 1995, to Ciccia and titled UNIVERSAL HAND GRIP DEVICE, describes a removable grip that can be used by either right-handed or left-handed describes a grip that supposedly provides for an accurate approach and contact with a golf ball for better distance and control.

United States Patent No. Des. 355,011, issued Jan. 31, 1995, to Subnick, and titled GOLF PUTTER GRIP, shows a golf putter handle that is an elongate rectangle. A golfer grips the narrow portion of the rectangle.

United States Patent No. Des. 399,901, issued Oct. 20, 1998, and titled GOLF PUTTER GRIP, shows a golf putter handle that is triangular in cross-section.

Accordingly, it is a principal object of the present invention to provide a golf putter grip and method that tend to cause the elbows of a user to press against the body of the user.

A further object of the present invention is to provide such a golf putter grip and method that assure that the golf putter is gripped the same way each time it is used.

An additional object of the present invention is to provide such a golf putter grip that is economically constructed using conventional techniques.

Other objects of the present invention, as well as particular features, elements, and advantages thereof, will be elucidated in, or be apparent from, the following description and the accompanying drawing figure.

SUMMARY OF THE INVENTION

The present invention achieves the above objects, among others, by providing, in a preferred embodiment, a grip for a golf putter, comprising: a center member; and two side members coaxially aligned side-by-side with said center member, such as to define therebetween two grooves each of said two grooves disposed between one of said side members and said center member. A method of using said grip for a golf putter is also provided.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
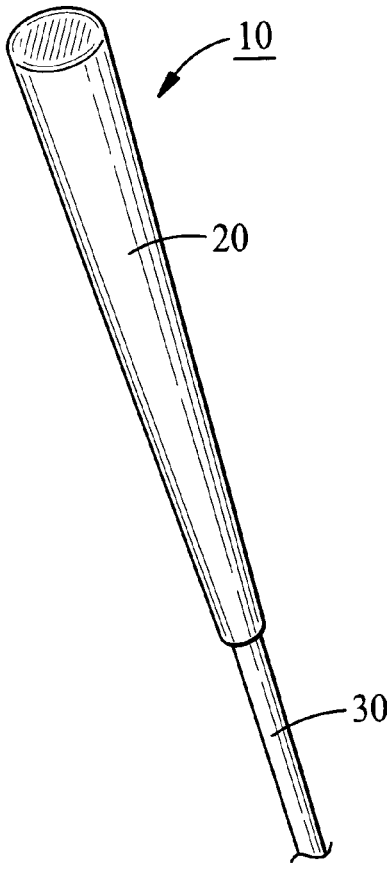
FIG. 1 is a fragmentary isometric view of a conventional golf putter.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

FIG. 1 illustrates a conventional golf putter, generally indicated by the reference numeral 10. Golf putter 10 includes a conventional, slightly truncated conical grip 20, tapering from a wider distal end to a narrower proximal end. A golf club shaft 30, parallel to the major axis of grip 20 extends centrally from the grip to a head (not shown on FIG. 1) of conventional configuration.

Figure 2:
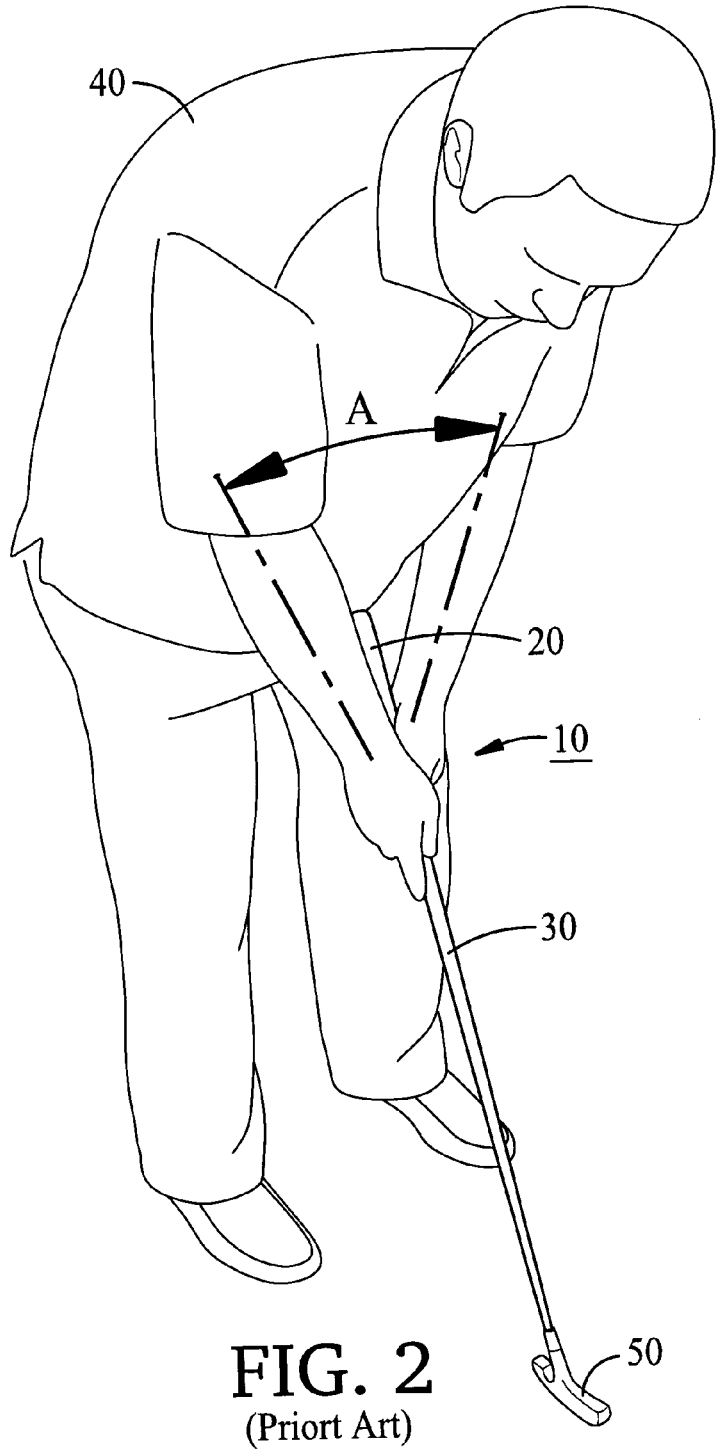
FIG. 2 is an isometric view of a golfer using a conventional golf putter.

FIG. 2 illustrates a golfer 40 gripping conventional golf putter 10 in a conventional manner for a right-handed golfer, with his right hand below his left hand. A left-handed golfer would grip golf putter with his left hand below his right hand. Also shown on FIG. 2 is a golf putter head 50 of conventional construction. Of particular note on FIG. 2 is the relatively wide angle "A" made by the golfer's forearms. This relatively wide angle tends to cause the elbows of the golfer to be disposed away from the golfer's body so that club 10 is relatively unstable in use.

Figure 3:
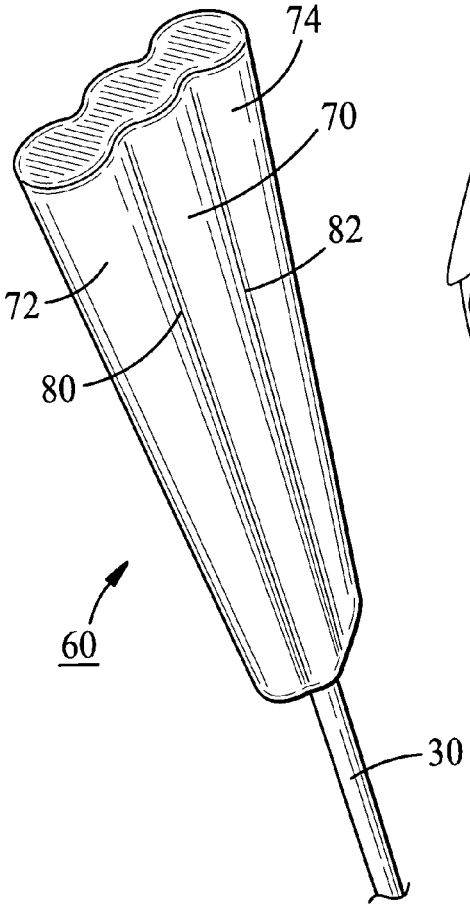
FIG. 3 is a fragmentary isometric view of golf putter constructed according to the present invention.

FIG. 3 illustrates a golf putter, constructed according to the present invention, and generally indicated by the reference numeral 60. The grip of golf putter 60 comprises a center, slightly truncated conical member 70 with slightly truncated conical side members 72 and 74 aligned with center member 70 as shown on FIG. 3, with each member having a wider distal end portion and a narrower proximal end portion. A conventional shaft 30 extends parallely and centrally from center member 70 and terminates at its distal end in a conventional head (not shown on FIG. 3). It will be noted on FIG. 3 that the intersections of side members 72 and 74 with center member 70 comprise grooves 80 and 82 having an angle therebetween of about five degrees, due to the slight truncated conical nature of the members. Members 70, 72, and 74 are each about one-inch in diameter at the distal end thereof narrowing to about three-quarters-inch at the proximal end thereof and about ten inches in length. Grooves 80 and 82 are each about 0.3-inch deep. The grip of golf putter 60 is about three inches wide at its distal end narrowing to about two and one-quarter inches wide at its proximal end.

Figure 4:
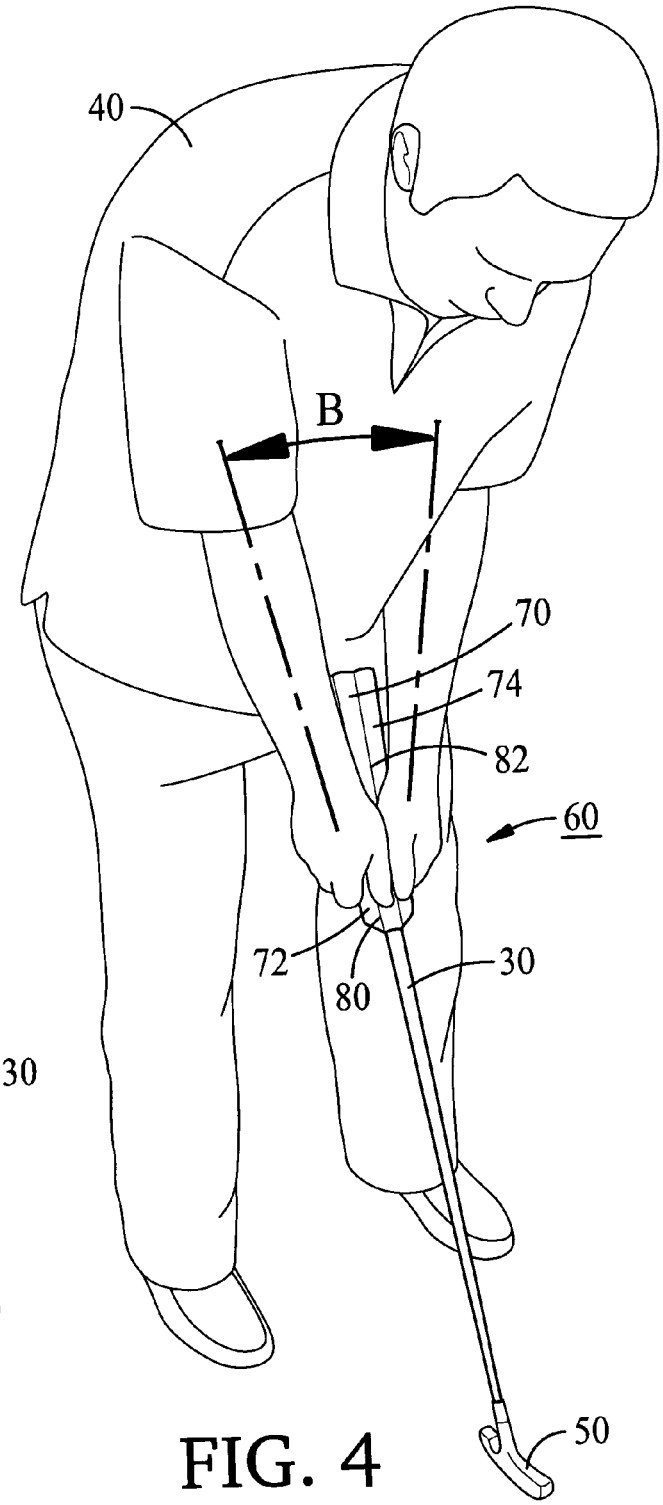
FIG. 4 is an isometric view of a golfer using a golf putter constructed according to the present invention.

FIG. 4 illustrates golfer 40 using golf putter 60, with his thumbs placed side-by-side in grooves 80 and 82. Imaginary lines passing parallely through the centers of members 70, 72 and 74 represent the path of travel of the golf ball (not shown) when stroked. These lines lie in a plane orthogonal to the plane in which lies the face of head 50 of golf putter 60.

Golfer 40 has grasped outer members 72 and 74 so that his thumbs lie in grooves 80 and 82. The hands of golfer 40 are now side-by-side, with his thumbs and fingers touching or nearly touching. This action causes the elbows of golfer 40 to press firmly against his side, as indicated by arrow "B" on FIG. 4, creating a firm holding posture such that the shoulders, elbows, and wrists of the golfer become very stable. The actual putting stroke is accomplished by movement of the body, torso, and knees.

Figure 5:
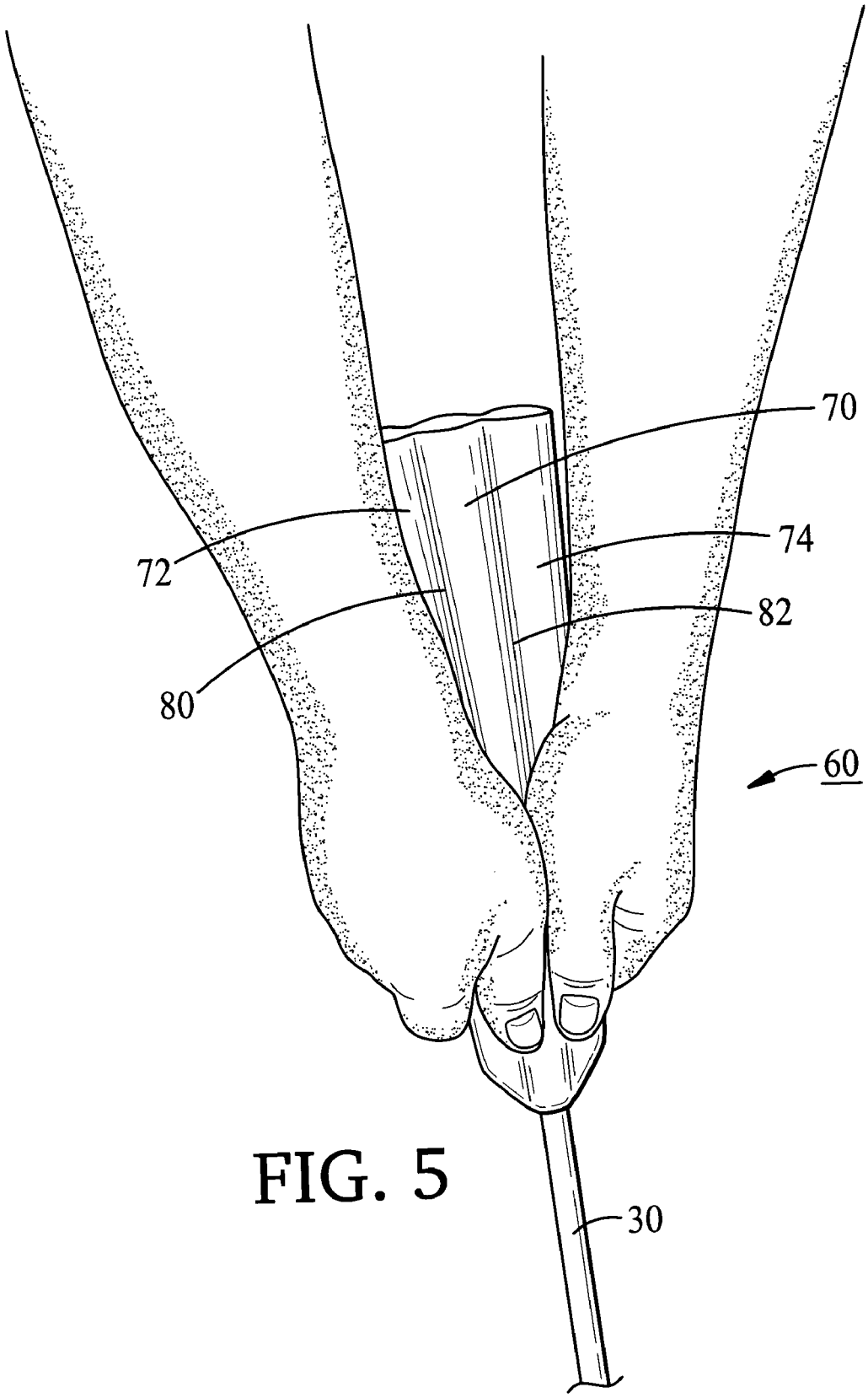
FIG. 5 is a fragmentary isometric view of a golfer gripping a golf putter constructed according to the present invention.

FIG. 5 illustrates in more detail golfer 40 (FIG. 4) grasping grip 60. As can be seen on FIG. 5, the thumbs of the golfer are disposed side-by-side in grooves 80 and 82 and are touching or nearly touching. This position causes the angle indicated by arrow "B" (FIG. 4) to be easily achieved.

Figure 6:
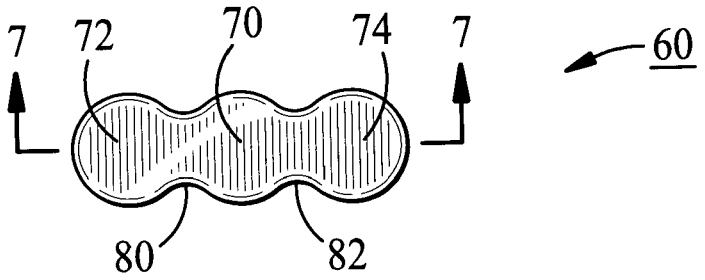
FIG. 6 is a top plan view of the golf putter of the present invention.
Figure 7:
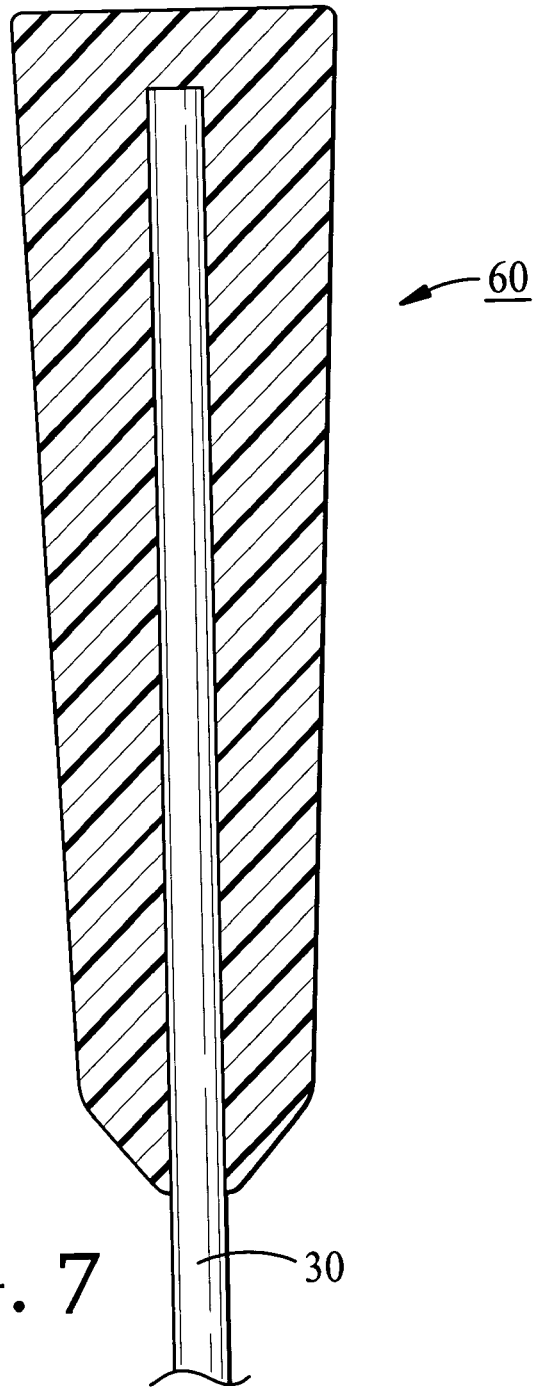
FIG. 7 is a side elevational view, partially in cross-section, of a golf putter grip constructed according to the present invention.

FIG. 6 illustrates golf putter 60 in top plan view, while FIG. 7 is taken along line "7—7" of FIG. 6.

Golf putter can be economically constructed of a suitable thermoplastic material using conventional molding techniques.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. A grip for a golf putter, comprising:

(a) a center member;

(b) two side members aligned side-by-side with said center member, defining therebetween two grooves each of said two grooves disposed between one of said side members and said center member; and (c) said center member and said two side members are slightly truncated cones, with distal ends thereof being slightly wider than proximal ends thereof.

2. A grip for a golf putter, as defined in claim 1, wherein: said center member and said two side members are generally cylindrical and each is about one-inch in diameter at its distal end narrowing to about three-quarter-inch in diameter at its proximal end.

3. A grip for a golf putter, as defined in claim 1, wherein: said grooves define an angle of about five degrees therebetween.

4. A grip for a golf putter, as defined in claim 1, wherein: imaginary lines drawn through major axes of said center member and said two side members lie in a plane orthogonal to a plane in which lies a face of a head of a putter shaft to which said grip for a golf putter is attached.

5. A grip for a golf putter, as defined in claim 1, wherein: each of said two grooves is about 0.3-inch deep.

6. A method of using a grip for a golf putter, comprising:

(a) providing a center member;

(b) providing two side members aligned side-by-side with said center member, defining therebetween two grooves each of said two grooves disposed between one of said side members and said center member;

(c) grasping said grip with thumbs of a user disposed in said two grooves; and (d) providing said center member and said two side members as slightly truncated cones, with distal ends thereof being slightly wider than proximal ends thereof.

7. A method of using a grip for a golf putter, as defined in claim 6, further comprising: providing said center member and said two side members each about one-inch in diameter at its distal end narrowing to about three-quarter-inch in diameter at its proximal end.

8. A method of using a grip for a golf putter, as defined in claim 6, further comprising: providing said grooves to define an angle of about five degrees therebetween.

9. A method of using a grip for a golf putter, as defined in claim 6, further comprising: providing said center member and said two side members such that imaginary lines drawn through major axes of said center member and said two side members lie in a plane orthogonal to a plane in which lies a face of a head of a putter shaft to which said grip for a golf putter is attached.

* * * * *